US005439284A

United States Patent [19]

Grabher

[11] Patent Number: 5,439,284

[45] Date of Patent: Aug. 8, 1995

[54] DRAWER WITH DETACHABLE CONNECTION OF DRAWER CASING AND DRAWER RAIL

[75] Inventor: Guenter Grabher, Fussach, Austria

[73] Assignee: Grass AG, Hochst/Vlbg., Austria

[21] Appl. No.: 144,271

[22] Filed: Oct. 27, 1993

[30] Foreign Application Priority Data

Nov. 10, 1992 [DE] Germany ..... 9215250 U

[51] Int. Cl.[6] ..... A47B 88/00

[52] U.S. Cl. ..... 312/334.6

[58] Field of Search ..... 312/334.6, 334.7, 334.8, 312/334.12

[56] References Cited

U.S. PATENT DOCUMENTS 4,004,841 1/1977 Vander Ley ..... 312/334.9

4,473,262 9/1984 Staye ..... 312/333

5,281,021 1/1994 Röck et al. ..... 312/334.32

FOREIGN PATENT DOCUMENTS 4201277 7/1993 Germany ..... 312/334.6

*Primary Examiner*—James R. Brittain

*Assistant Examiner*—Robert J. Sandy

[57] ABSTRACT

A drawer slide for connecting a drawer to a cabinet has a drawer rail detachably mounted to an inner profile of a drawer casing. The drawer rail has a hook arranged in the longitudinal direction which pivotally engages the drawer casing. A locking mechanism is provided on the drawer casing, which releasably locks the drawer casing to the drawer rail. The locking mechanism is releasable without the necessity of manipulation by hand.

6 Claims, 3 Drawing Sheets

DRAWER WITH DETACHABLE CONNECTION OF DRAWER CASING AND DRAWER RAIL

BACKGROUND OF THE INVENTION

The present invention relates to drawer slides, such as the one disclosed, for example, in EP 0 421 458 A1, in which the drawer rail is detachably conenected to a drawer casing, following a straight sliding movement lengthwise of the drawer rail.

A disadvantage of the prior art drawer slide is that the locking mechanism must be manipulated by hand, which makes the operation extraordinarily difficult. The drawer can only be unlatched and lifted out when a catch component is squeezed out by means of a release component from a recess in the drawer casing. It must be operated manually, blindly, and with a disadvantageous drawer slide system having the locking device in an unpractical position on the cabinet.

These disadvantages are especially apparent when the drawer is built in tightly over the ground in a furniture or cabinet component. Moreover, another disadvantage of the prior art slide is that to remove the drawer out of the drawer slide, the release component of the locking mechanism must be operated simultaneously on both sides of the drawer slide. This can also be dangerous and injurious.

The drawer slide disclosed in DE 33 47 540 possesses fundamentally the same disadvantages.

OBJECTS OF THE INVENTION

An object of the present invention is to develop an improved drawer slide, having a locking mechanism for detachably locking the drawer to the slide which can be operated without manual effort.

The solution to these defined problems is found in the technical information described herein.

SUMMARY OF THE INVENTION

In the present invention, the drawer locking device is engaged without requiring the use of manual manipulation, due to the form-fitting position of the locking mechanism, which is firmly connected to the drawer casing in the demounted state. Because of the firm connection in the demounted state, the drawer can be operated without a manual release component and can be lifted out from the drawer rails. Additionally, in a preferred embodiment, the spring resistance of a half-round leaf spring must be overcome. The advantage is that no manual manipulation is necessary and that to release the locking mechanism of the drawer, the front must merely be lifted out and over raised hooks which form a pivot in the back part of the drawer slide.

The locking mechanism consists out of a one-piece metal part, while the previous locking mechanisms consist of plastic and, therefore, have a tendency towards brittleness which adversely affects the durability.

In a preferred embodiment, the locking mechanism consists of at least two locking components, of which one fits from the upper side of the drawer casing to the shank, and the other locking component fits from the underside to the same shank of the drawer casing.

It is advantageous when both locking components lie slanted opposite each other relative to the horizontal shank of the drawer casing, arranged next to each other, in order to counteract a tilted pitch of the drawer side slide rail.

It is preferred when the upper locking component is formed as a latch; that is, when the upper locking component is spring loaded to snap in a notch in the horizontal shank of the drawer. With this latch, a locking mechanism prevents shifting in the longitudinal directions of the drawer slide.

The bottom locking component consists preferably of at least one tab which fits on the underside of the horizontal shank of the drawer casing. The tab is connected via a leaf spring to a clamp, which is fastened to the drawer casing.

The upper and bottom locking components fit on the upper and lower sides of the horizontal shank of the drawer casing, thus forming the locking mechanism.

It is obviously possible that the orientations of the upper locking component and bottom locking component could be reversed. This must be understood as fundamental to the innovation.

To release the locking mechanism, it is sufficient to hold the front of the drawer up. Thereby, both mentioned locking components of the locking mechanism become angularly inclined with respect to the lengthwise axle of the drawer rail. Due to the spring action of the leaf spring, the drawer rail now tilts against the fundamental supporting bottom tabs and disengages from the horizontal shank. Simultaneously, the latch tilts out of the coordinating notches in the drawer rail, whereby the locking engagement of the locking mechanism between the drawer casing and drawer rail is lifted out.

To latch the locking mechanism, the inverse holds true, as will be demonstrated more clearly in the drawings.

The innovative basis of the present invention results from not only the particulars and subject matter of the individual patent claims, but also the various combinations of the individual patent claims.

All records, documents, and evidence, inclusive of the summary, open and disclosed statements, declarations, indications and features, especially those represented embodiments in the drawings, will be claimed as fundamental and significant to the invention, as far as the claims, individually or in combinations, are relative to the position that the technology is new.

The present invention will be explained more precisely in the following detailed designs. Additional fundamental features and advantages result from these drawings and their descriptions.

DETAILED DESCRIPTION OF THE PREFERRED EMBODIMENT

A drawer has side walls, that are formed as the drawer casing (1). For simplicity, only one side of the drawer slide will be described since the other side is exactly identical.

The drawer casing (1) consists of a hollow chamber profile, in which an inner profile (6) having a horizontal shank (3) is installed.

Figure 2:
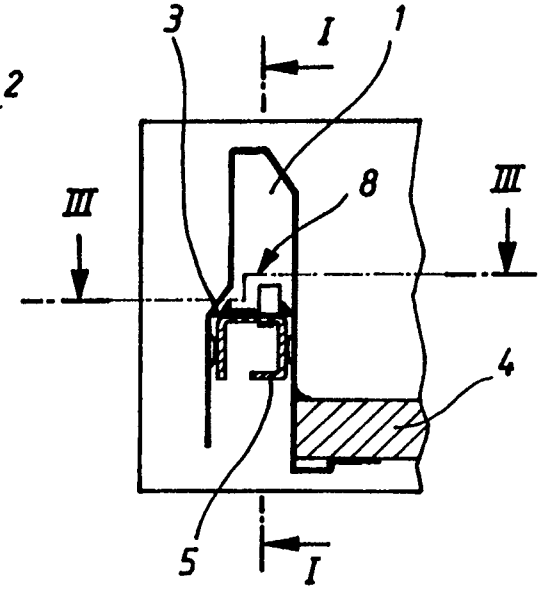
FIG. 2: Section along to the line II—II in FIG. 1.

The drawer casing (1) comprises a drawer bottom (4) as shown in FIG. 2, and is fastened to the front panel (2) by means of a fastening method which is not detailed in the figure.

The drawer casing (1) is releaseably connected to the corresponding drawer rail (5) along the horizontal shank (3) of the inner profile (6).

Figure 3:
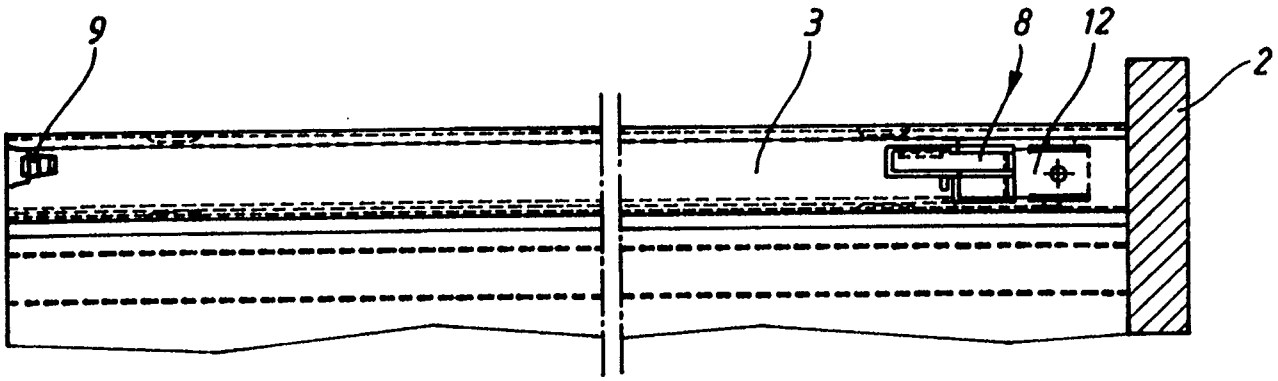
FIG. 3: Plan view of the lay-out, according to FIG. 1.
Figure 4:
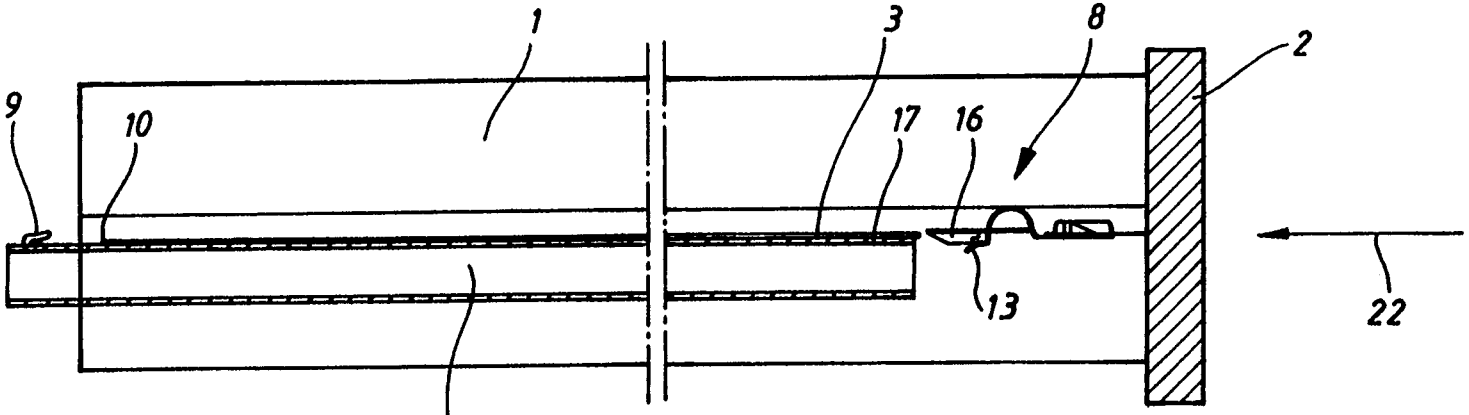
FIG. 4: The drawer slide shortly before the engagement of the locking mechanism.

In the back part of the drawer, the drawer rail (5) comprises an upward bending hook (9) that sits on the shank (3) of the inner profile (6), as more clearly shown in FIG. 3. In the locked position, the hook (9) carries the drawer rail (5) in the rear area. In the front area, the connection between the drawer casing (1) and the drawer rail (5) is made by means of the locking mechanism (8). As more clearly shown in FIGS. 6–8, the locking mechanism (8) consists fundamentally of a clamp (12), which is tightly fastened to the horizontal shank (3) of the drawer rail (1). Therefore, a connection is provided by means of a slot in the horizontal shank (3) slot, into which barb (14) engages and fits against the upper side of the horizontal shank (3), as shown in FIG. 8.

Additionally, another bore hole can be provided in the area of the clamp (12) in order to fit a threaded or riveted joint.

Figure 8:
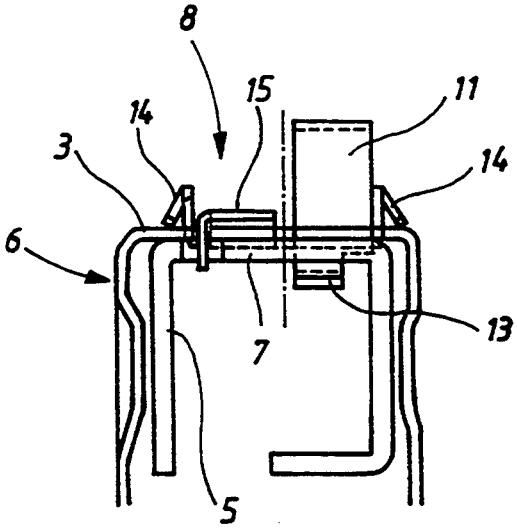
FIG. 8: Front view of the locking mechanism, according to FIG. 6.

As shown in FIG. 8, the drawer rail (5) consists fundamentally of a partially open hollow chamber profile. Drawer rail (5) is connected along its horizontal shank (7) with the corresponding horizontal shank (3) of the inner profile (6) of the drawer casing (1) over the locking mechanism (8).

Figure 6:
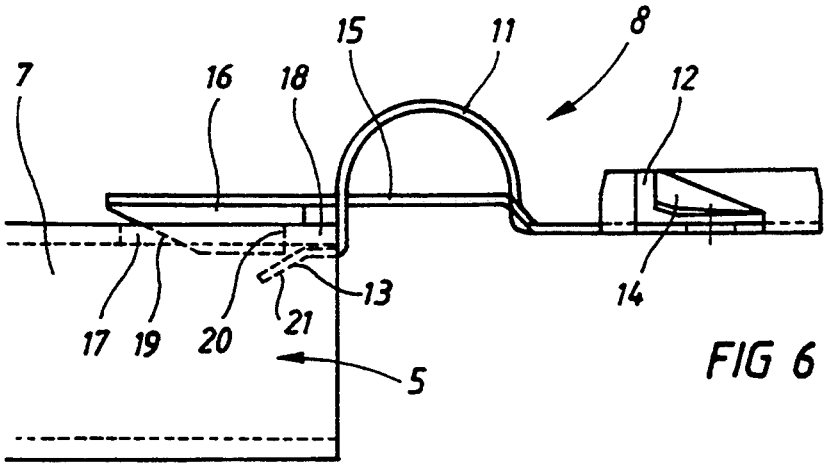
FIG. 6: The locking mechanism in the lock position.

The locking mechanism consists fundamentally of a latch (16), which is connected by a spring formed latch (15) to a clamp (12). In the locked position, the latch (16) engages in a corresponding notch (17) in horizontal shank (7) of drawer rail (5), as shown in FIG. 6.

Figure 7:
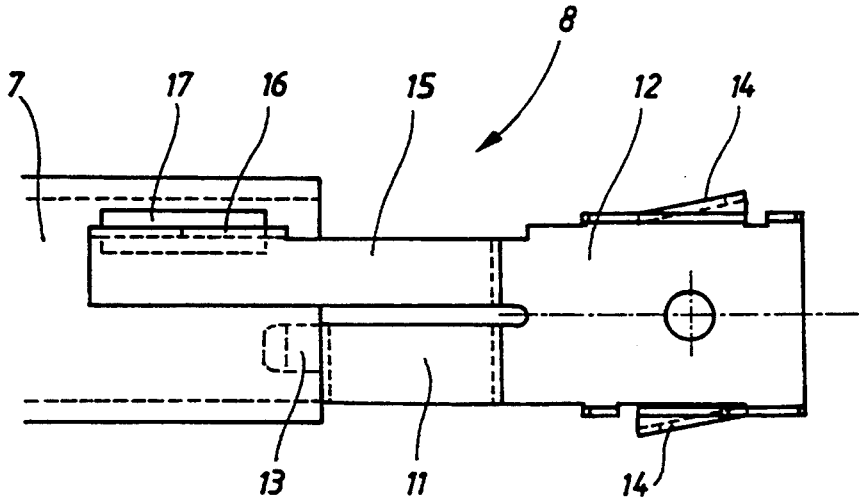
FIG. 7: Top view of the locking mechanism, according to FIG. 6.

The latch (16) is inserted at its free end, which is initially in the pulled-out position. The end of latch (16) is pointed with a lower pitch (19). The latch fits with a corresponding projection (20) against the back entering edge of the notch (17) to the horizontal shank (7) of drawer rail (5). The width of the latch (16) is narrower than the width of the notch (17), as shown in FIG. 7, in order to guarantee that the drawer rail can also be locked when the lock mechanism (8) is laterally displaced.

Laterally offset from the latch (16) is a tab (13) which grips the horizontal shank (7) of the drawer rail (5).

The tab (13) possesses a pitch (21) which bends downward and is inserted against the underside of the front face (18) of the horizontal shank (7). The tab (13) is fastened at the end of an arc-shaped bent leaf spring (11), which is in turn fastened to clamp (12) of the locking mechanism (8). To latch the drawer rail (5) with the drawer casing (1), the drawer is shifted in the direction of arrow (22). The back front face (10) of the horizontal shank (3) of the drawer casing (1) contacts the upward bending hook (9) of the drawer rail (5) and both parts interlock.

Figure 1:
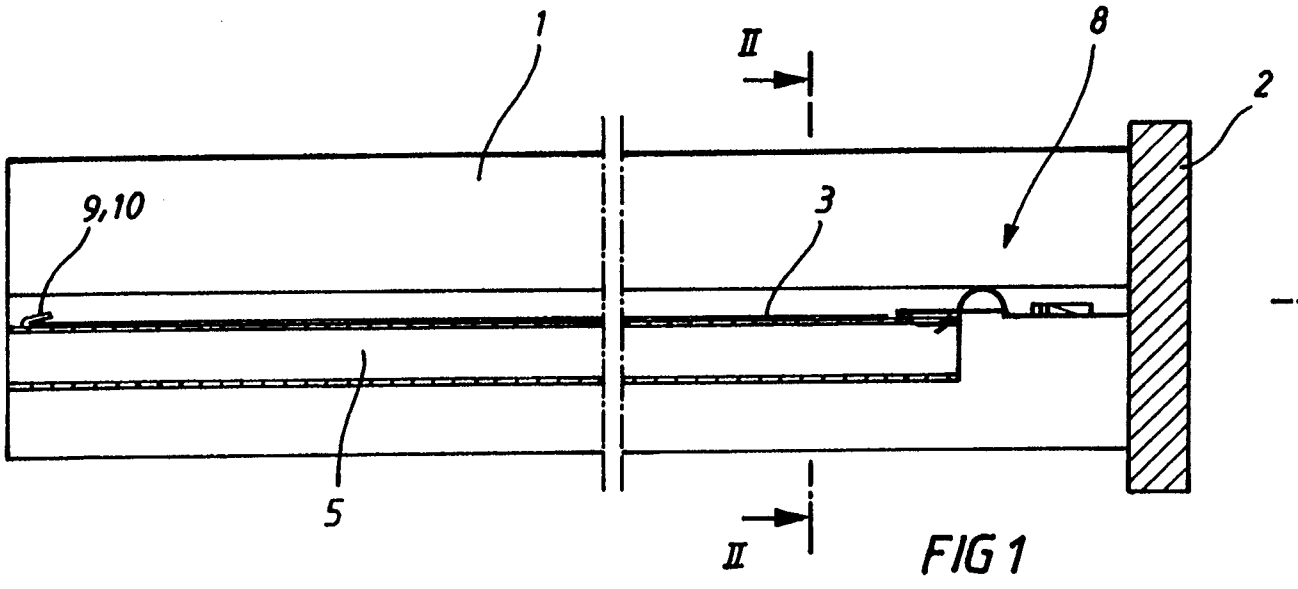
FIG. 1: The drawer slide in section, according to I—I in FIG. 2 in the locked position.

Simultaneously, the pitch (19) meets the latch (16) on the front face (18) of the horizontal shank (7) and is lifted by the spring action of the latch (15) and slides over the upper side of the horizontal shank (7) as long as, until the latch (16) locks into the notch (17). Simultaneously the pitch (21) of the tab (13) grips underneath the same front face (18) of the shank (7). As the pitch (21) grips the front fact (18) of the shank (7), the leaf spring (11) is fundamentally not contorted. In the locked position, the locking mechanism latches and the drawer is in the functional position, as more clearly shown in FIGS. 1 through 3.

Figure 5:
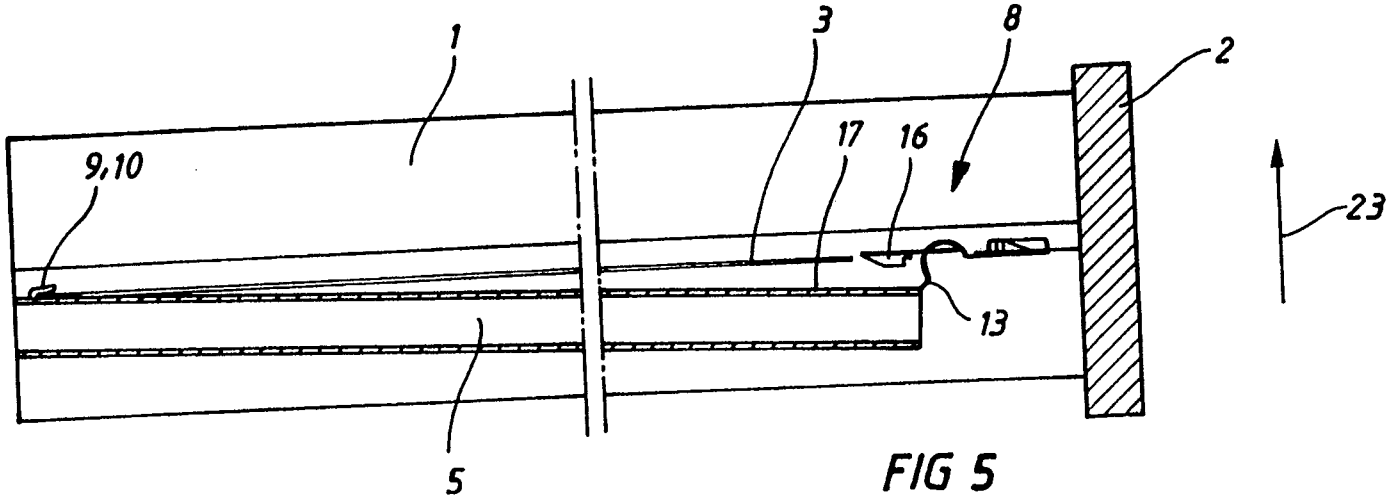
FIG. 5: The drawer slide, according to FIG. 4 in position shortly after the disengagement of the locking mechanism.

To disengage the locking mechanism (8), the front panel (2) is lifted out in the direction of arrow (23) Thereby, the latch (16) disengages from notch (17) in the horizontal shank (7) of drawer rail (5). Simultaneously the leaf spring (11) bends downward, as shown in FIG. 5, at the place where the pitch (21) of the tab (13) meets and engages on the front face (18) of the shank (7). Then, an additional lifting of the front panel (2) in the direction of arrow (23) causes the spring resistance of the leaf spring (11) to be surmounted, thus disengaging tab (13) from the shank (7). With this, the locking mechanism (8) is lifted out and with a small shifting motion of the drawer casing (1) in the direction of arrow (22). With this motion, the backward hook (9) is also disengaged from the front face (10) of the shank (7) of the drawer rail (5).

From these explanatory descriptions, it follows that the locking mechanism (8) completely, without manual manipulation, that is, it operates without a release or locking lever. The locking mechanism (8) is formed preferably as a one-piece metal part; however, it can also be made out of a plastic part.

What is claimed is:

1. A drawer slide for connecting a drawer to a cabinet, the drawer having a drawer casing and a front panel, and an inner profile disposed within the drawer casing, the drawer slide comprising:

a drawer rail having a horizontal shank, the drawer rail being detachably connectable to the drawer casing inner profile;

a hook affixed to the horizontal shank of the drawer rail, the hook facing the direction in which the drawer is pulled out and functioning as a pivot bearing around which the inner profile is pivotable; and a locking mechanism affixed to the inner profile for releaseably locking the drawer rail to the inner profile;

wherein the locking mechanism locks and releases independently of manipulation.

2. A drawer slide as recited in claim 1, wherein:

said horizontal shank of said drawer rail has an upper side and a lower side; and said locking mechanism comprises an upper locking component and a lower locking component, the upper locking component fitting against the upper side of the horizontal shank of the drawer rail, and the lower locking component fitting against the lower side of the horizontal shank of the drawer rail.

3. A drawer slide as recited in claim 2 wherein:

said horizontal shank of said drawer rail has a notch formed therein; and one of said locking components is formed as a spring latch which engages in the notch in the horizontal shank of the drawer rail.

4. A drawer slide as recited in claim 2; wherein one of said locking components comprises a tab fitting against the lower side of the horizontal shank of said drawer casing, the tab being fastened to a leaf spring, and the leaf spring being connected to said inner profile.

5. A drawer slide as recited in claim 3 or claim 4, further comprising a clamp connecting said upper and lower locking components to said inner profile.

6. A drawer slide as recited in claim 5, wherein said upper and lower locking components are fastened adjacently on said clamp.

* * * * *